US006679623B2

(12) United States Patent
Kim

(10) Patent No.: US 6,679,623 B2
(45) Date of Patent: Jan. 20, 2004

(54) APPARATUS FOR AGITATING LIQUID HARDENER USED FOR IMPROVING SOFT GROUND

(75) Inventor: Young-Gwan Kim, Seoul (KR)

(73) Assignee: Keubyuck Engineering Co., Ltd., Seoul (KR)

( * ) Notice: Subject to any disclaimer, the term of this patent is extended or adjusted under 35 U.S.C. 154(b) by 58 days.

(21) Appl. No.: 10/091,413

(22) Filed: Mar. 5, 2002

(65) Prior Publication Data

US 2003/0099151 A1 May 29, 2003

(30) Foreign Application Priority Data

Nov. 29, 2001 (KR) ..... UM 2001-36851

(51) Int. Cl.[7] ..... B01F 7/22

(52) U.S. Cl. ..... 366/138; 366/143; 366/155.1; 366/181.4; 366/297; 366/314

(58) Field of Search ..... 366/155.1, 297, 366/314, 143, 138, 181.4, 605

(56) References Cited

U.S. PATENT DOCUMENTS 673,143 A * 4/1901 Sette ..... 366/297
780,588 A * 1/1905 Walber ..... 366/297
1,374,445 A * 4/1921 Greenawalt ..... 366/107
2,574,391 A * 11/1951 Herrly ..... 366/261
2,603,461 A * 7/1952 Marienthal ..... 366/605
2,757,910 A * 8/1956 O'Neill ..... 366/605
2,848,019 A * 8/1958 Corbin et al. ..... 366/605
2,917,465 A * 12/1959 Begley ..... 366/155.1
2,923,438 A * 2/1960 Logan et al. ..... 366/605
3,054,230 A * 9/1962 Logue ..... 366/291
3,827,888 A * 8/1974 Terwilliger et al. ..... 366/160.3
4,401,645 A * 8/1983 Gisler ..... 366/327.1
4,867,052 A * 9/1989 Cipelletti ..... 366/155.1
5,192,130 A * 3/1993 Endo et al. ..... 366/155.1
5,195,824 A * 3/1993 Stromberg et al. ..... 366/131

* cited by examiner

*Primary Examiner*—Tony G. Soohoo
(74) *Attorney, Agent, or Firm*—Pennie & Edmonds LLP

(57) ABSTRACT

Disclosed is an apparatus for agitating a liquid hardener used for improving soft ground. The apparatus comprises a storage tank section formed with an introduction part and having storage tanks in which mixing impellers are arranged, and transparent indicator tubes which are communicated with the storage tanks each; an agitation tank section positioned underneath the storage tank section and having agitation tanks, supply valves which are installed on the agitation tanks, and agitation impellers which are respectively arranged in the agitation tanks; a liquid mixture supply section having connection pipes which are connected to the storage tanks, a supply pipe which is connected to the connection pipes, and distribution pipes which are connected to the supply pipe; and a cleaning water tank section positioned in front of the agitation tank section and having a plurality of cleaning water tanks.

2 Claims, 5 Drawing Sheets

APPARATUS FOR AGITATING LIQUID HARDENER USED FOR IMPROVING SOFT GROUND

BACKGROUND OF THE INVENTION

1. Field of the Invention

The present invention relates to an apparatus for agitating a liquid hardener used for improving soft ground, and more particularly, the present invention relates to an apparatus for agitating a liquid hardener, which is configured in such a way as to sufficiently and reliably agitate the liquid hardener and secure a maximum agitation capacity while occupying a minimum space.

2. Description of the Related Art

Generally, in order to improve soft ground in depth, including marine clay or stratified clay, a wide variety of methods had been disclosed in the art, such as a deep mixing method of soil stabilization in which a liquid hardener is mixed with soil, a chemical grouting method in which a liquid mixture of chemicals is injected into soil, and so forth. After the soft ground is reinforced in these methods, structures can be constructed on rigidified soil.

In particular, in the chemical grouting method, it is to be noted that, after the chemicals are mixed in a mixing chamber and thereby a liquid hardener is prepared, the liquid hardener should be supplied through an appropriate supply section while it is prevented from being coagulated or precipitated due to its chemical characteristic. In this regard, the present applicant disclosed in Korean Utility Model Registration No. 219079 an apparatus for agitating a liquid hardener used for improving soft ground, which will be explained in detail with reference to the attached drawings.

FIG. 4 is a perspective view illustrating a conventional apparatus for agitating a liquid hardener; and FIG. 5 is a side cross-sectional view of FIG. 4. As shown in FIGS. 4 and 5, the conventional liquid hardener agitating apparatus includes a storage tank 130, an agitation tank 150 and a cleaning water tank 160. An introduction hopper 110 is formed at a rear upper end of the storage tank 130, and storage chambers 132 are defined in the storage tank 130 by partitioning walls. Mixing impellers 122 are respectively arranged in the storage chambers 132 in a manner such that they are driven by motors 120, respectively, mounted to an upper wall of the storage tank 130. The agitation tank 150 is integrally formed at a lower end of the storage tank 130. Agitation chambers 152 are defined in the agitation tank 150 by partitioning walls in a manner such that they are respectively associated with the storage chambers 132. The storage chambers 132 and the agitation chambers 152 are communicated with each other through discharge pipes 140 on which opening/closing valves are installed, respectively. The cleaning water tank 160 is integrally formed at a front end of the agitation tank 150.

Agitation scrappers 150*a*, which are coupled via a connecting rod to a cam which in turn is interlocked through reduction gears with a driving motor, are arranged in the agitation chambers 152, respectively, in a manner such that they can be pivoted forward and rearward within the range of a predetermined angle to agitate a liquid mixture of chemicals serving as a liquid hardener.

In the conventional liquid hardener agitating apparatus constructed as mentioned above, while the liquid hardener is agitated by the agitation scrappers 150*a* arranged in the agitation chambers 152, to be prevented from being coagulated or precipitated, a problem is caused in that, since the storage tank 130 and the agitation tank 150 have a rectangular configuration and the agitation scrappers 150*a* arranged in the agitation chambers 152 are pivoted forward and rearward within the range of the predetermined angle to agitate the liquid hardener, due to a pivoting radius of the agitation scrappers 150*a*, the agitating apparatus cannot but occupy a large space, and the liquid hardener cannot be sufficiently and reliably agitated. Further, because the agitation tank 150 has only two agitation chambers 152, the conventional agitating apparatus cannot have a large agitation capacity.

SUMMARY OF THE INVENTION

Accordingly, the present invention has been made in an effort to solve the problems occurring in the related art, and an object of the present invention is to provide an apparatus for agitating a liquid hardener used for improving soft ground, which is configured in such a way as to sufficiently and reliably agitate the liquid hardener and secure a maximum agitation capacity while occupying a minimum space.

In order to achieve the above object, according to one aspect of the present invention, there is provided an apparatus for agitating a liquid hardener used for improving soft ground, comprising: a storage tank section formed, at a rear upper end thereof, with an introduction part, and having a plurality of storage tanks in which mixing impellers are arranged in such a way as to be respectively driven by motors mounted to upper walls of the storage tanks, the storage tank section further having transparent indicator tubes which are disposed in front of and communicated with the storage tanks each to indicate an amount of a liquid mixture serving as the liquid hardener; an agitation tank section positioned underneath the storage tank section and having a plurality of agitation tanks which are respectively associated with the storage tanks of the storage tank section and each of which has a circular section shape and supply valves which are installed on the agitation tanks, the agitation tank section further having agitation impellers which are respectively arranged in and adjacent to lower ends of the agitation tanks in such a way as to be rotatably driven by a common driving motor; a liquid mixture supply section having connection pipes which are connected at one ends thereof to the storage tanks and on which opening/closing valves are installed, a supply pipe which is connected at one end thereof to the other ends of the connection pipes, and distribution pipes which are connected at one ends thereof to the other end of the supply pipe and on which discharge valves are installed to allow discharge of the liquid mixture contained in the storage tanks into the agitation tanks; and a cleaning water tank section positioned in front of the agitation tank section and having a plurality of cleaning water tanks which are integrally formed with the agitation tanks, respectively.

According to another aspect of the present invention, the storage tank section has first through fourth storage tanks, and the agitation tank section has first through fourth agitation tanks.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
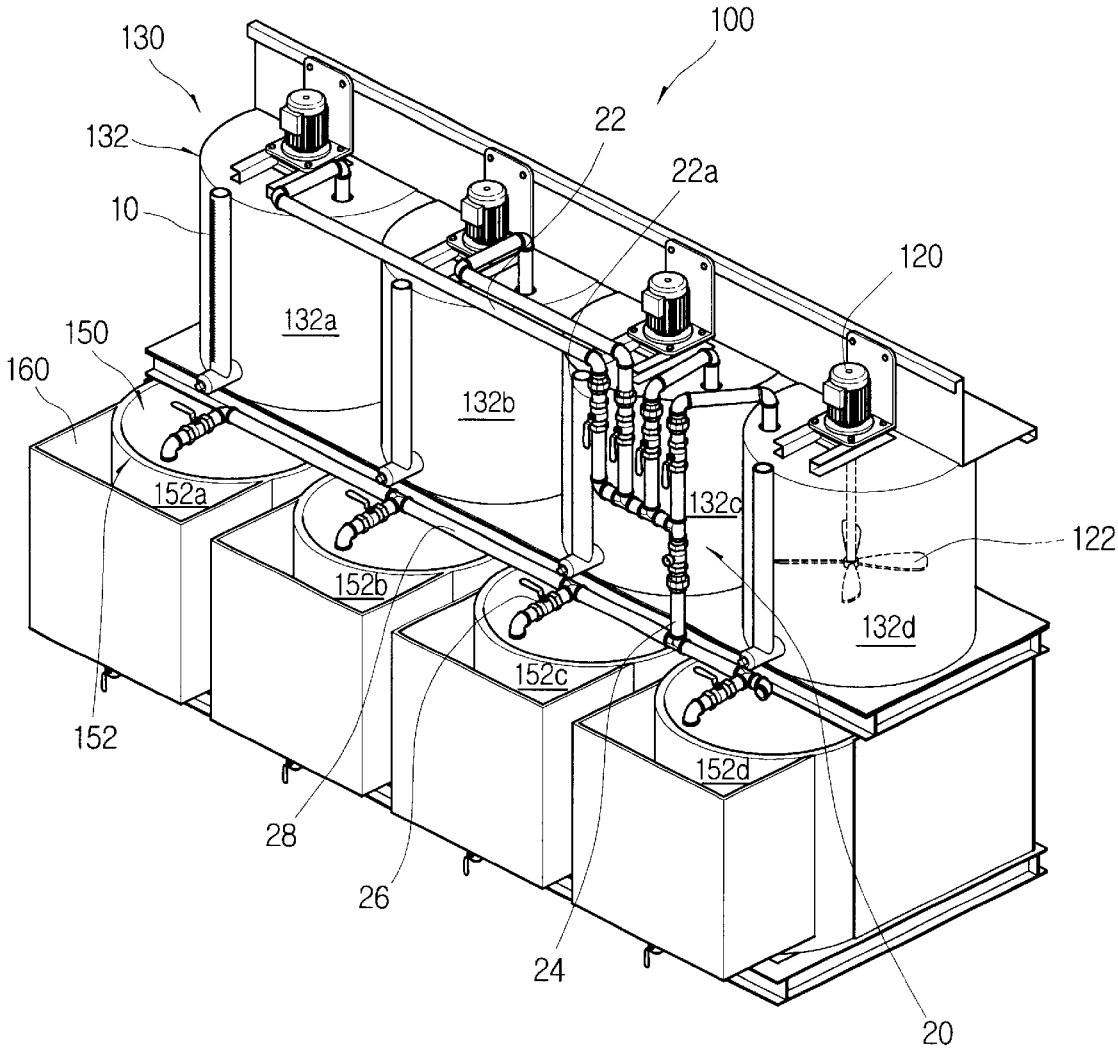
FIG. 1 is a perspective view illustrating an apparatus for agitating a liquid hardener in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
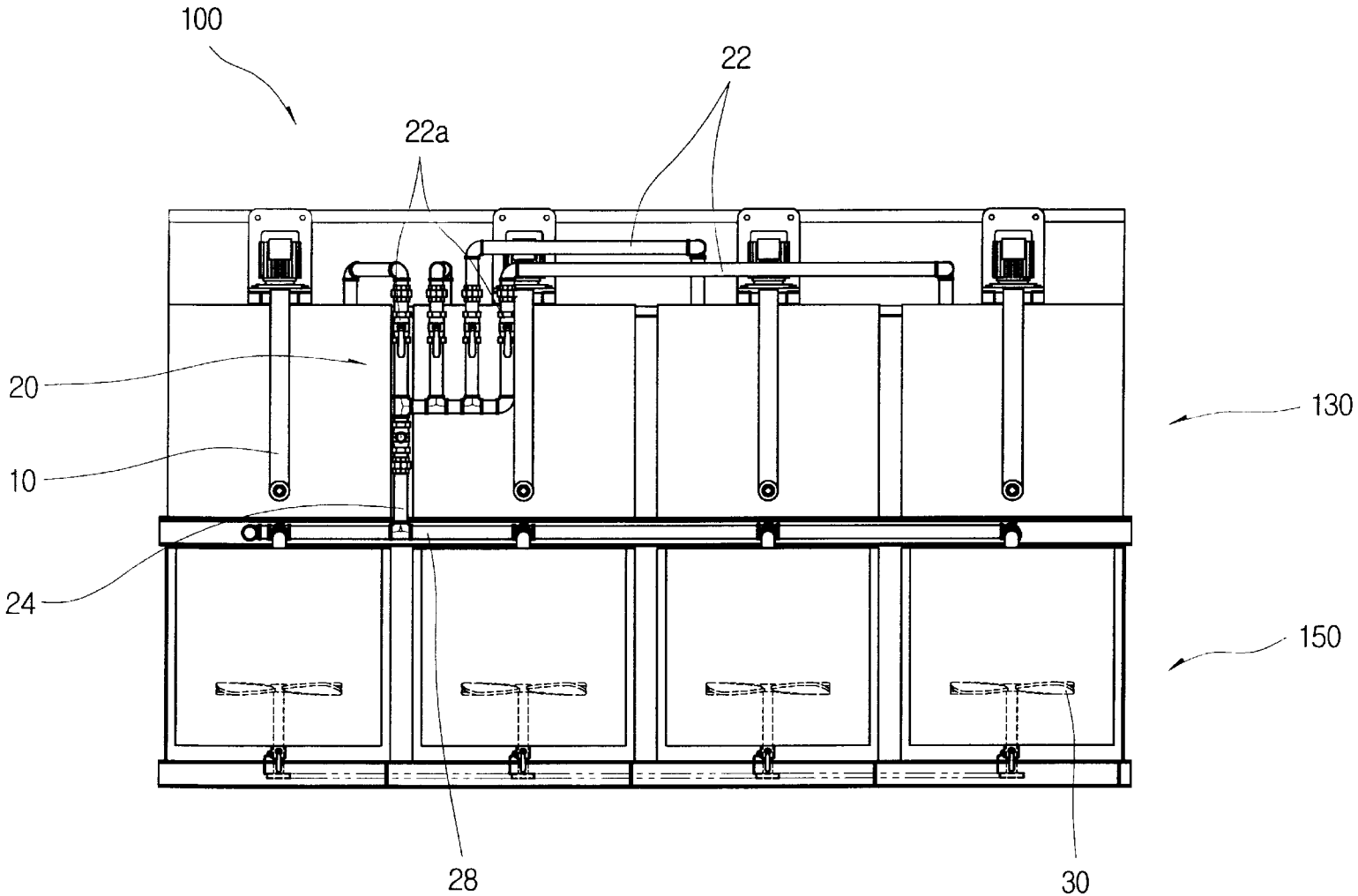
FIG. 2 is a front view of FIG. 1.

FIG. 1 is a perspective view illustrating an apparatus for agitating a liquid hardener in accordance with an embodiment of the present invention; FIG. 2 is a front view of FIG. 1; and FIG. 3 is a side view of FIG. 1.

Figure 3:
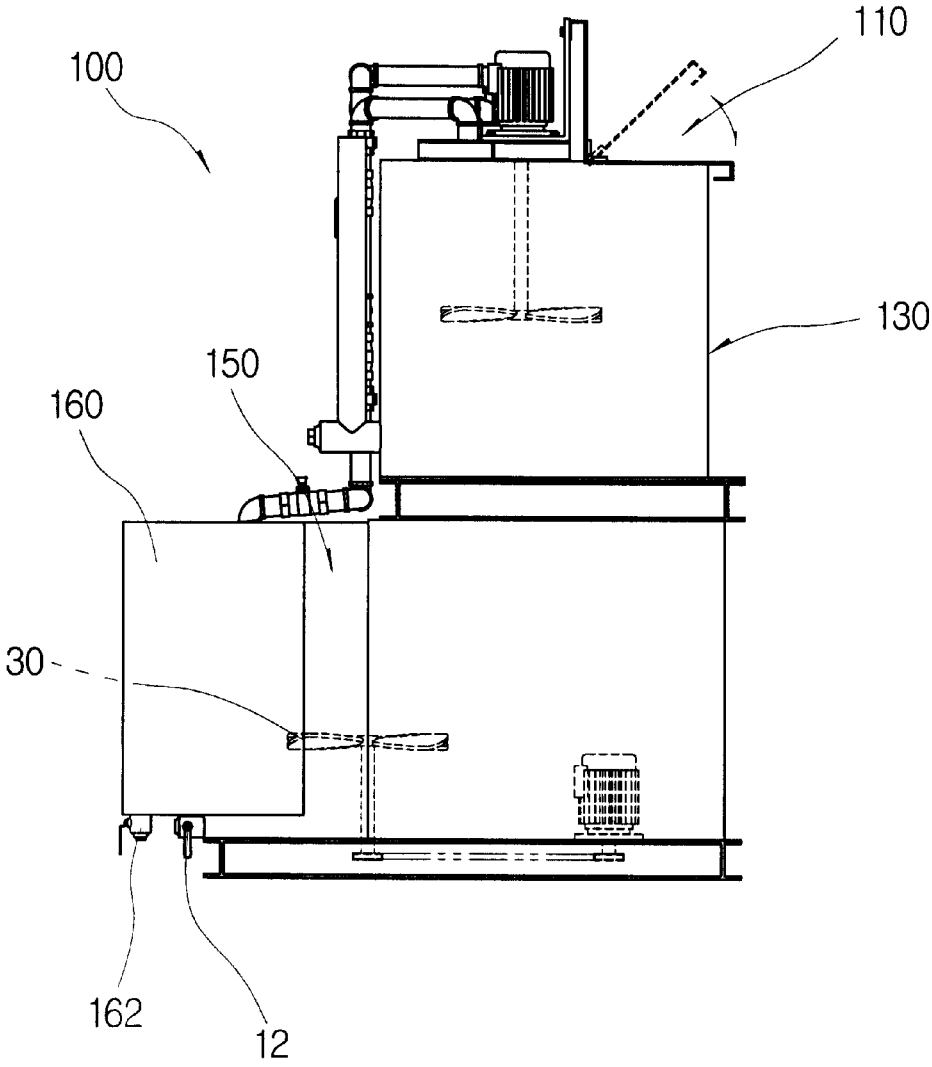
FIG. 3 is a side view of FIG. 1.
Figure 4:
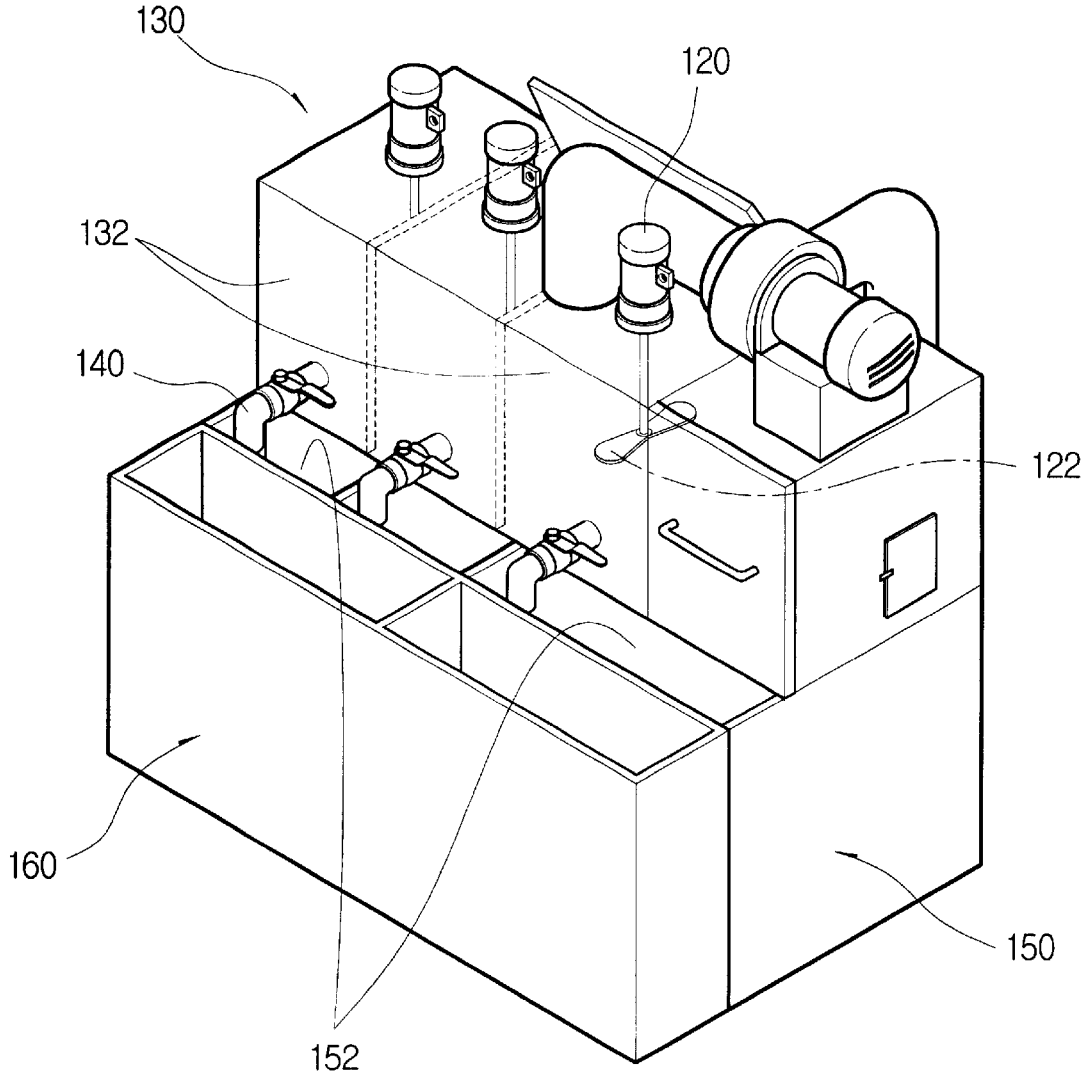
FIG. 4 is a perspective view illustrating a conventional apparatus for agitating a liquid hardener.
Figure 5:
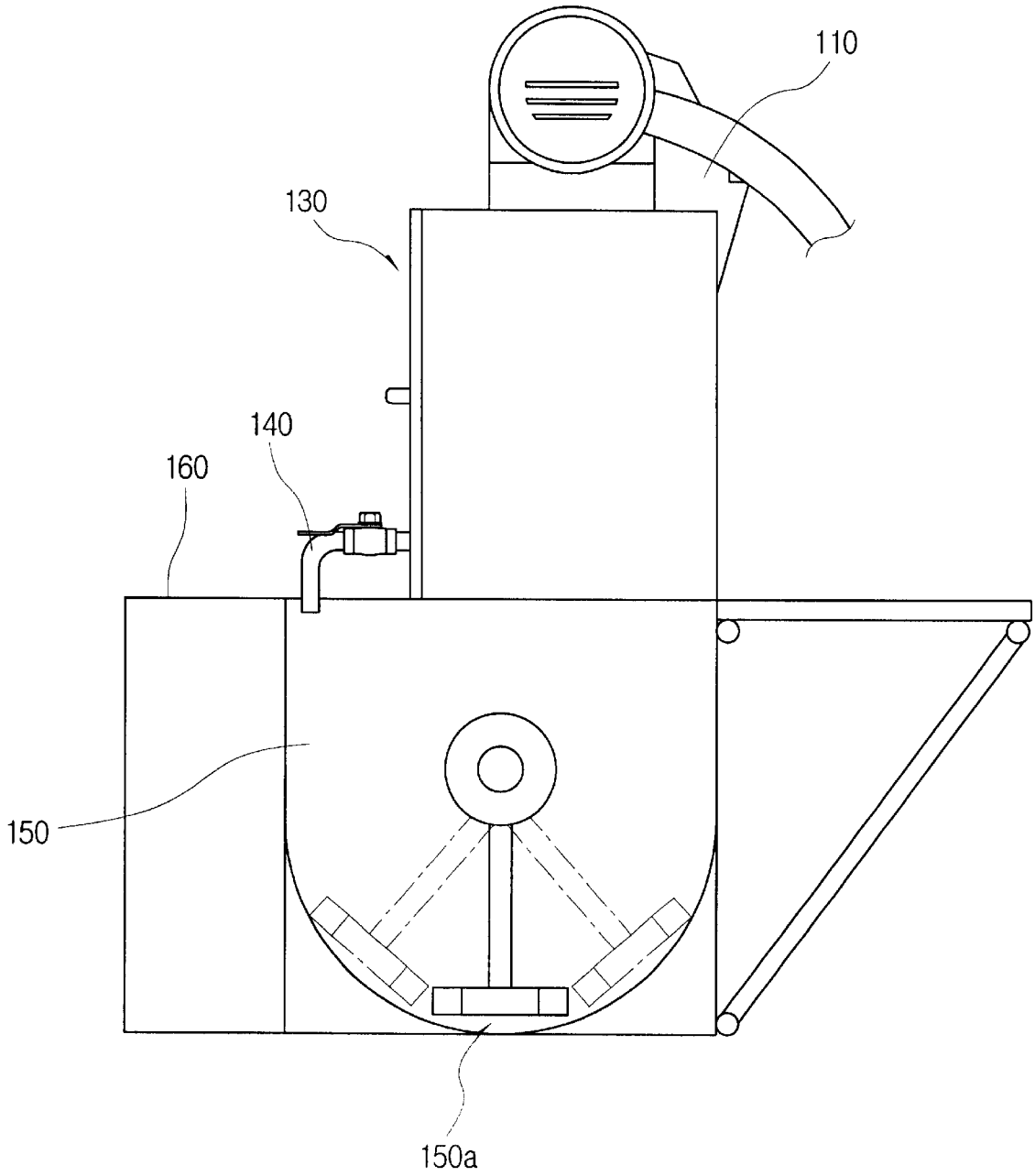
FIG. 5 is a side cross-sectional view of FIG. 4.

As shown in FIGS. 1 through 3, a liquid hardener agitating apparatus according to the present invention includes a storage tank section 130, an agitation tank section 150, a liquid mixture supply section 20 and a cleaning water tank section 160. The storage tank section 130 is formed, at a rear upper end thereof, with an introduction part 110 so that quick-setting and slow-setting agents acting as a rigidifying agent of a powdered form and cement can be introduced into the storage tank section 130 through the introduction part 110. The introduction part 110 has a shape of a hopper, or is configured in a manner such that it is opened and closed using a hinge structure. The storage tank section 130 has a plurality of storage tanks 132 in which mixing impellers 122 are arranged in such a way as to be respectively driven by motors 120 mounted to upper walls of the storage tanks 132. The storage tanks 132 function to mix chemicals introduced therein. The storage tank section 130 further has transparent indicator tubes 10 which are disposed in front of and communicated with the storage tanks 132 each to indicate an amount of a liquid mixture serving as a liquid hardener. Therefore, a total amount of introduced chemicals and a remaining amount of a liquid mixture can be easily confirmed from the outside. The agitation tank section 150 is positioned underneath the storage tank section 130. The agitation tank section 150 has a plurality of agitation tanks 152 which are respectively associated with the storage tanks 132 of the storage tank section 130 and each of which has a circular section shape, and supply valves 12 which are installed on the agitation tanks 152. The agitation tanks 152 function to agitate the liquid mixture and thereby prevent the liquid mixture from being coagulated or precipitated. The agitation tank section 150 further has agitation impellers 30 which are respectively arranged in and adjacent to lower ends of the agitation tanks 152 in such a way as to be rotatably driven by a common driving motor. The liquid mixture supply section 20 has connection pipes 22 which are connected at one ends thereof to the storage tanks 132 and on which opening/closing valves 22*a* are installed, a supply pipe 24 which is connected at one end thereof to the other ends of the connection pipes 22, and distribution pipes 28 which are connected at one ends thereof to the other end of the supply pipe 24 and on which discharge valves 26 are installed to allow discharge of the liquid mixture contained in the storage tanks 132 into the agitation tanks 152. The cleaning water tank section 160 is positioned in front of the agitation tank section 150 and has a plurality of cleaning water tanks which are integrally formed with the agitation tanks 152 and on which drain valves 162 are installed.

As in the conventional art, power transmission means for rotating the agitation impellers 30 may comprise, for example, sprockets one of which is rotatably driven by the driving motor and a chain which is wound on the sprockets.

In order to ensure that the storage tank section 130 and the agitation tank section 150 have large mixing and agitating capabilities when compared to the conventional storage tank and agitation tank, it is preferred that the storage tank section 130 has first through fourth storage tanks 132*a*, 132*b*, 132*c* and 132*d*, and the agitation tank section 150 has first through fourth agitation tanks 152*a*, 152*b*, 152*c* and 152*d*.

In the liquid hardener agitating apparatus according to the present invention, constructed as mentioned above, quick-setting and slow-setting agents acting as a rigidifying agent of a powdered form and cement are introduced at a predetermined ratio by a worker through the introduction part 110 formed at the rear upper end of the storage tank section 130, into each storage tank 132 in which silica and water are already mixed at a desired ratio. At this time, due to the fact that the transparent indicator tubes 10 are disposed in front of the storage tanks 132, a total amount of chemicals introduced into each storage tank 132 and a remaining amount of a liquid mixture can be easily confirmed by the worker from the outside.

The quick-setting and slow-setting agents and cement introduced in this way into the storage tank section 130 are sufficiently mixed in the respective storage tanks 132 by the mixing impellers 122 which are respectively rotated by the motors 120. Thereafter, the liquid mixture prepared thereby is discharged through the liquid mixture supply section 20 into the agitation tanks 152 which are respectively positioned underneath and associated with the storage tanks 132. At this time, in the liquid mixture supply section 20, by adequately manipulating the opening/closing valves 22*a* installed on the connection pipes 22 and the discharge valves 26 installed on the distribution pipes 28, the liquid mixture can be controllably supplied from at least one selected storage tank 132 into at least one selected agitation tank 152.

Then, the liquid mixture discharged into the agitation tanks 152 is agitated by the agitation impellers 30 which are respectively arranged in and adjacent to the lower ends of the agitation tanks 152 in such a way as to be rotatably driven by the common driving motor, whereby the liquid mixture is prevented from being coagulated or precipitated due to a chemical characteristic of the quick-setting and slow-setting agents.

As a consequence, the liquid mixture, that is, the liquid hardener can be supplied to a desired place through the supply valves 12 installed on the respective agitation tanks 152 and via a supply pump, a flowmeter and a main pressing arrangement in a state wherein it is not coagulated or precipitated.

After supply of the liquid hardener is completed, the agitation tanks 152 of the agitation tank section 150 are cleaned using water accommodated in the cleaning water tanks of the cleaning water tank section 160, which are positioned in front of and integrally formed with the agitation tanks 152.

As apparent from the above description, the liquid hardener agitating apparatus according to the present invention provides advantages in that, since each of storage tanks and agitation tanks has a circular section shape and agitation impellers are respectively arranged in the agitation tanks in such a way as to be rotatably driven by common driving means, a liquid hardener can be agitated in a sufficient and reliable manner, and a maximum agitation capacity can be obtained while occupying a minimum space.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An apparatus for agitating a liquid hardener used for improving soft ground, comprising:

a storage tank section formed, at a rear upper end thereof, with an introduction part, and having a plurality of storage tanks in which mixing impellers are arranged in such a way as to be respectively driven by motors mounted to upper walls of the storage tanks, the storage tank section further having transparent indicator tubes which are disposed in front of and communicated with the storage tanks each to indicate an amount of a liquid mixture serving as the liquid hardener;

an agitation tank section positioned underneath the storage tank section and having a plurality of agitation tanks which are respectively associated with the storage tanks of the storage tank section and each of which has a circular section shape and supply valves which are installed on the agitation tanks, the agitation tank section further having agitation impellers which are respectively arranged in and adjacent to lower ends of the agitation tanks in such a way as to be rotatably driven by a common driving motor;

a liquid mixture supply section having connection pipes which are connected at one ends thereof to the storage tanks and on which opening/closing valves are installed, a supply pipe which is connected at one end thereof to the other ends of the connection pipes, and distribution pipes which are connected at one ends thereof to the other end of the supply pipe and on which discharge valves are installed to allow discharge of the liquid mixture contained in the storage tanks into the agitation tanks; and a cleaning water tank section positioned in front of the agitation tank section and having a plurality of cleaning water tanks which are integrally formed with the agitation tanks, respectively.

2. The apparatus as set forth in claim 1, wherein the storage tank section has first through fourth storage tanks, and the agitation tank section has first through fourth agitation tanks.

* * * * *